US010393347B2

(12) United States Patent
Benitez et al.

(10) Patent No.: US 10,393,347 B2
(45) Date of Patent: Aug. 27, 2019

(54) THIN LUMINAIRE

(71) Applicants: LPI-EUROPE, S.L., Pozuelo, Madrid (ES); LIGHT PRESCRIPTIONS INNOVATORS, LLC, Altadena, CA (US)

(72) Inventors: Pablo Benitez, Madrid (ES); Juan Carlos Minano, Madrid (ES); Ruben Mohedano, Madrid (ES); Julio C. Chaves, Coimbra (PT); Waqidi Falicoff, Talent, OR (US)

(73) Assignee: SEOUL SEMICONDUCTORS CO., LTD., Gyeonggi-do (KR)

( * ) Notice: Subject to any disclaimer, the term of this patent is extended or adjusted under 35 U.S.C. 154(b) by 299 days.

(21) Appl. No.: 14/771,076

(22) PCT Filed: Mar. 11, 2014

(86) PCT No.: PCT/US2014/023496

§ 371 (c)(1),
(2) Date: Aug. 27, 2015

(87) PCT Pub. No.: WO2014/164792

PCT Pub. Date: Oct. 9, 2014

(65) Prior Publication Data

US 2016/0010811 A1 Jan. 14, 2016

Related U.S. Application Data

(60) Provisional application No. 61/851,611, filed on Mar. 12, 2013.

(51) Int. Cl.
*F21S 8/04* (2006.01)
*F21V 5/00* (2018.01)
(Continued)

(52) U.S. Cl.
CPC ..... *F21V 13/04* (2013.01); *F21S 8/04* (2013.01); *F21S 41/143* (2018.01);
(Continued)

(58) Field of Classification Search
CPC ..... F21V 5/007; F21V 14/006; F21V 14/06; F21V 14/065
(Continued)

(56) References Cited

U.S. PATENT DOCUMENTS 3,736,416 A * 5/1973 Goodwin ..... B60Q 1/0023 362/276
3,780,286 A * 12/1973 Alexieff ..... F21S 8/02 362/235
(Continued)

FOREIGN PATENT DOCUMENTS

JP 2010122372 A 6/2010
WO 2001086198 A1 11/2001
(Continued)

OTHER PUBLICATIONS

European Patent Office, Partial Supplementary European Search Report for Appl. No. 14778729.5, dated Feb. 28, 2017, 8 pages.
(Continued)

*Primary Examiner* — Bryon T Gyllstrom
(74) *Attorney, Agent, or Firm* — Drinker Biddle & Reath LLP

(57) ABSTRACT

A luminaire includes a mixing chamber having an array of apertures in one wall, a light source to supply light into the mixing chamber, and an array of optics outside the mixing chamber, each positioned to cooperate with a respective one of the apertures to emit light from the mixing chamber as a beam. The shape, size, and/or direction of the output light
(Continued)

beam are controllably varied by controlling the shape, size, and/or position of each aperture relative to its associated optic.

14 Claims, 11 Drawing Sheets

(51) Int. Cl.

| | |
|---|---|
| ***G09F 9/33*** | (2006.01) |
| ***F21S 41/43*** | (2018.01) |
| ***F21V 11/14*** | (2006.01) |
| ***F21V 11/18*** | (2006.01) |
| ***F21V 13/04*** | (2006.01) |
| ***G09F 13/22*** | (2006.01) |
| ***F21S 41/143*** | (2018.01) |
| ***F21S 41/265*** | (2018.01) |
| ***F21Y 105/10*** | (2016.01) |
| ***F21Y 107/20*** | (2016.01) |
| ***F21Y 115/10*** | (2016.01) |

(52) U.S. Cl.
CPC ..... *F21S 41/265* (2018.01); *F21S 41/43* (2018.01); *F21V 5/007* (2013.01); *F21V 11/14* (2013.01); *F21V 11/186* (2013.01); *G09F 9/33* (2013.01); *F21Y 2105/10* (2016.08); *F21Y 2107/20* (2016.08); *F21Y 2115/10* (2016.08); *G09F 2013/222* (2013.01)

(58) Field of Classification Search
USPC ..... 362/268
See application file for complete search history.

(56) References Cited

U.S. PATENT DOCUMENTS 4,949,227 A * 8/1990 Finch ..... B60Q 1/0011 362/232
6,373,633 B1 * 4/2002 Brown ..... B23K 26/0604 359/618
6,769,777 B1 * 8/2004 Dubin ..... F21V 5/04 353/38
7,806,547 B2 10/2010 Benitez
8,297,796 B2 * 10/2012 Catalano ..... F21L 14/023 359/15
8,723,426 B2 5/2014 Young
8,783,887 B2 * 7/2014 Caruso ..... F21V 9/10 313/467
2001/0006222 A1 * 7/2001 Gebele ..... G01T 1/2014 250/584
2002/0024808 A1 * 2/2002 Suehiro ..... G09F 13/22 362/245
2004/0105616 A1 * 6/2004 Kazama ..... G02B 6/3556 385/18
2006/0285312 A1 12/2006 Ogawa
2010/0061090 A1 * 3/2010 Bergman ..... F21V 5/007 362/231
2012/0057350 A1 * 3/2012 Freier ..... F21V 14/04 362/279
2012/0124872 A1 5/2012 Lim
2015/0159828 A1 * 6/2015 Joergensen ..... F21V 5/004 362/235
2015/0330588 A1 * 11/2015 Snyder ..... F21S 48/1154 362/516

FOREIGN PATENT DOCUMENTS

| | | | |
|---|---|---|---|
| WO | 2009/004511 | A1 | 1/2009 |
| WO | 2010047798 | A1 | 4/2010 |
| WO | 2011013972 | A2 | 2/2011 |
| WO | 2011/132108 | A1 | 10/2011 |

OTHER PUBLICATIONS

The International Search Report and the Written Opinion of the International Searching Authority (dated Jul. 11, 2014).

* cited by examiner 304
303
305
302
301
300

402
401
400

1101
1100

1205
1207
1204
1206
1203
1208
1201
1202
1200

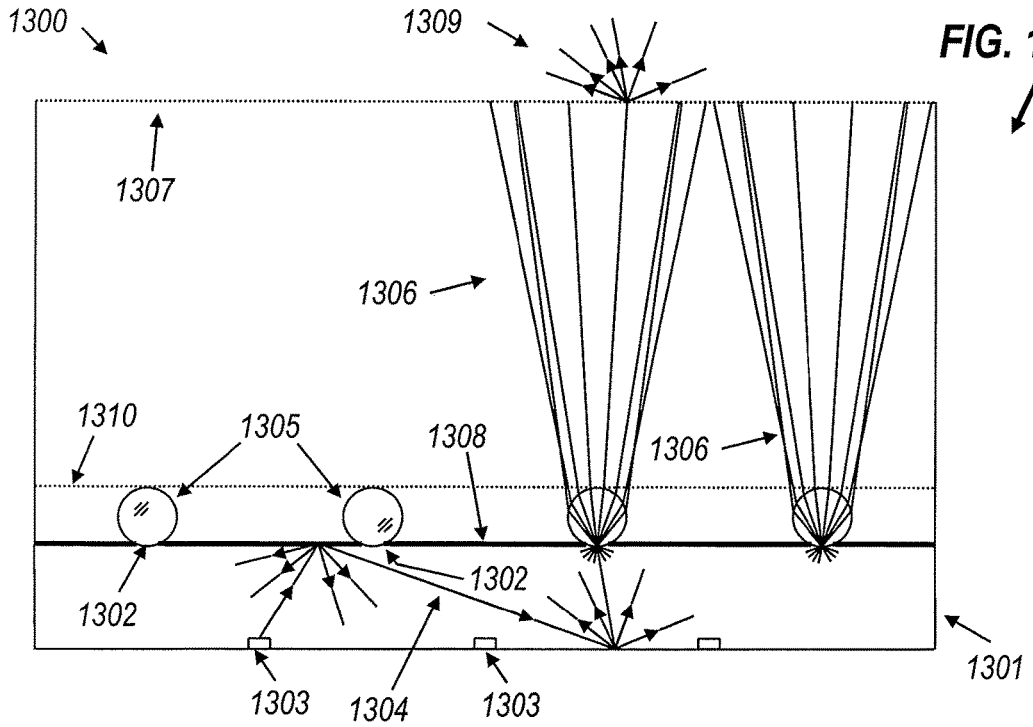
FIG. 13
FIG. 14
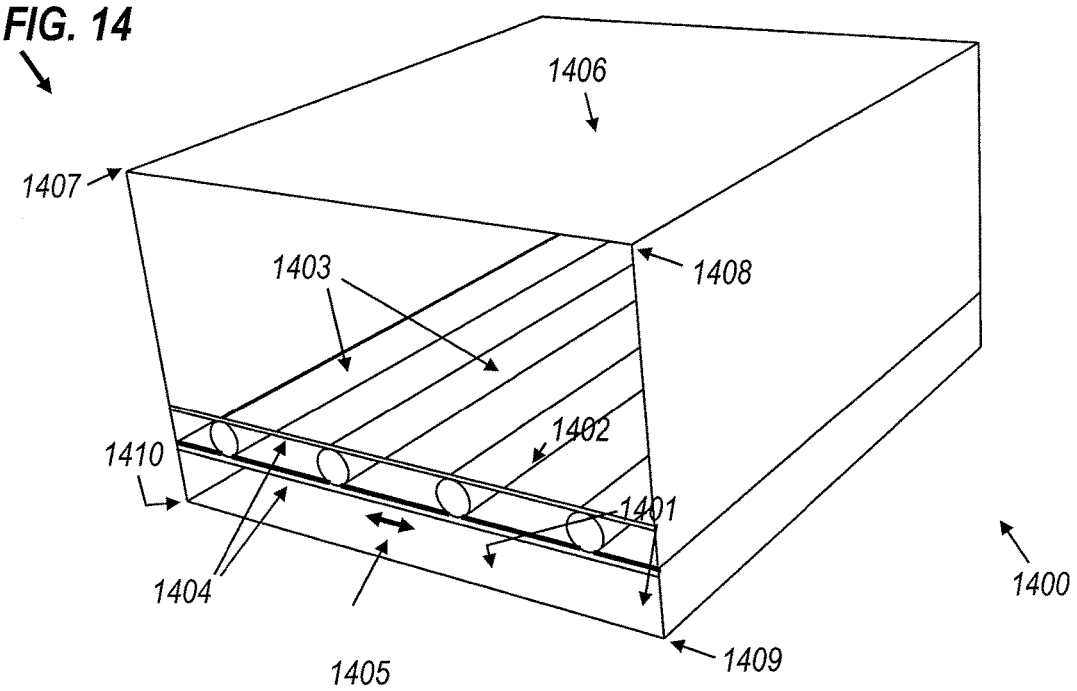

THIN LUMINAIRE

CROSS-REFERENCE TO RELATED APPLICATION

Priority is hereby claimed to U.S. Provisional Patent Application No. 61/851,611, filed Mar. 12, 2013, entitled Ultra-Thin Luminaire, which is incorporated by reference herein in its entirety.

Reference is made to U.S. Pat. No. 7,806,547, which has several inventors in common with the present invention and which is incorporated by reference herein in its entirety.

Part of the research/work leading to these results was supported by the European Union's Seventh Framework Programme (FP7/2007-2013) under Grant Agreement no 619912.

FIELD OF THE INVENTION

The present methods and apparatus relate generally to light-emitting diodes (LEDs) and other light sources, and more particularly to light collection/distribution systems that utilize and array of light sources.

BACKGROUND

U.S. Pat. No. 7,806,547 describes a backlight composed of a mixing chamber with LEDs and holes through which light escapes. This light is then captured by an array of optics (one for each hole) and emitted in a beam the central axis of which is perpendicular to the plane of the device. The luminaires of U.S. Pat. No. 7,806,547 are mainly aimed at producing backlights, and for that reason, have some notable limitations. The desired uniform output for backlights imposes a uniform distribution of holes and corresponding optics, which are all replicas of each other. All holes and corresponding optics are coplanar, which leads to a planar device, as desired for a backlight. The array of optics may be tailored to produce some degree of collimation, but the emission patterns that can be produced are limited. Also, the whole device is made to produce a desired light emission which is fixed and cannot be changed.

The present application aims at improving the earlier luminaires by introducing new degrees of freedom in the design process. By allowing varying shapes and relative positions across the device for the holes and corresponding optics, it is now possible to generate complex emission patterns. The possibility of moving parts relative to each other or replacing a limited number of parts in the system, allows for different emission patterns to be produced by the same device. Also disclosed in this invention is the possibility of having devices whose overall shape is no longer flat. This is useful in some applications, notably car headlamps designed with the new invention, whose overall shape now conforms to the shape of the car.

SUMMARY OF THE DISCLOSURE

Ultra-thin luminaires are described herein that provide the ability to combine an array of light emitting diodes or other type sources, including multiple color light sources, and produce beam outputs that are uniform and can be tailored to meet a wide variety of target prescriptions. The invention can be utilized for a wide variety of applications such as: commercial and residential downlights, theater lighting, automotive lighting including headlamps, and outdoor lighting such as wall washing and street lights, to name a few.

Embodiments of the luminaires described in this specification use a reflective mixing box (whose walls can be specular or diffusive or a combination of both). The light sources, which are preferably light emitting diodes (LEDs), are mounted on any of the surfaces of the mixing box either on its top, bottom or sides, or any combination of these surfaces. The invention can be used with an array of different light sources or with sources with approximately the same spectral output (e.g. binned LEDs). In either case the mixing box can if desired sufficiently homogenize the light sources so that the output is substantially spectrally uniform. At the top of the mixing box there are holes where the light from the mixing box escapes. The holes can take on any shape required. Also the holes do not have to be the same shape but can take on an infinite number of patterns. In this way the output beam pattern from each hole can be varied to produce an asymmetric prescription. In this specification, except where the context otherwise requires, "top" is used to refer to the side of the luminaire, usually the side more visible in use, through which light emerges from the luminaire. For a ceiling-mounted troffer, that side will usually be the bottom in use. For an automotive headlamp, as shown by way of example in FIG. 19, the "top" side will usually be the front in use. For other applications, the light emitting "top" side may face in any desired direction. The luminaires may be transported and stored in any convenient orientation.

Above each hole there is a refractive optical element that transforms the light emitted by the holes into the required beam pattern or patterns. In one preferred embodiment, the bottom of the refractive optics is planar and the top surface is convex. In other embodiments the bottom and top surfaces can be either convex or concave, or a free-form shape providing alternative prescriptive solutions. A novelty of the present luminaires is that the refractive optic for each hole can be offset laterally so that the optical axis is not squarely in line with the centroid of its corresponding hole. In the case where the hole is circular and the refractive optic is circular then the direction of the light output from the optic is no longer along the optical axis.

In a preferred embodiment all the holes are present on a single sheet. In some embodiments the mechanical design of the luminaire accommodates easy replacement of its existing sheet with another one. This allows the luminaire to be customized to produce any of a wide range of beam patterns either in the manufacturing process or in the field.

In a preferred embodiment, the array of refractive optical elements is molded as a single piece. In another embodiment the optical refractive elements are cylindrical and are proximate to holes which are also linear in shape. These cylindrical optical elements can be produced as individual pieces or injection molded together as an array. In some embodiments the aforementioned optical elements can be moved laterally either on their own or as one if they are molded as a single sheet. In some embodiments more than one sheet of refractive elements can be used and be moved laterally independently of the others.

The combination of variable shape holes in conjunction with freeform shaped surfaces of the refractive optical elements and the ability to change the alignment of these two parts, makes it possible for luminaires based on the present invention to achieve a wide variety of beam patterns. In one embodiment described herein the shape of the holes in a sheet containing an N×N array of holes is in the shape of the beam pattern for an automotive headlamp. The refractive elements have their focus on these headlamp patterns thereby imaging them in the far field. In another embodiment the holes are replaced with an array of LCDs which allow the shape and position of the holes to be dialed-in in real-time to produce low beam, high beam and DRL beam prescriptions.

In another embodiment the shape of the front surface of the luminaire is not planar but curved. In one embodiment the surface has one direction curvature. In other embodiments the shape can have double curvature. The curved embodiments are useful for applications where there is a requirement to be continuous with a curved surrounding surface, such as the case where the luminaire is incorporated into the curved surface of an automobile body.

In lighting applications that require excellent color mixing with tight beam control, embodiments of the present luminaire can excel. Embodiments of the present luminaires have significant advantages if used as a downlight or troffer. The luminaires can be made into thin panels, which can be installed in the ceiling, having the same dimension as troffers which use fluorescent tubes. The typical efficiency of the luminaires used in previously proposed troffers is on the order of 70%. Also these prior luminaires do not have the tight beam control that is possible with the present luminaires. Also the quality of light from fluorescent tubes is not always ideal for some applications, and the spectrum of the lamps cannot easily be adjusted. Embodiments of the present invention, on the other hand, allow for tuning of the light even while the luminaire is in use. The output can be a wide variety of white color temperatures or any one of several million colors. The utilization factor for embodiments of the present luminaires can be quite high compared to prior art using fluorescent tubes, as the optical efficiency of the system can be over 80% and all this light can be directed to the target.

Another novelty of embodiments of the present luminaires is the ability to have logos or images that can be seen when the luminaire is turned off or when it is turned off and on. Alternatively, the "image" can be a pattern chosen to blend in with the surrounding ceiling panels. This is accomplished by having image or images present on the top surface of the sheet with the holes so that the image is facing the refractive optical elements. This can be accomplished by printing, embossing or other techniques. In one embodiment this feature is molded into the sheet using a single material or using multi-shot injection techniques where multiple colored materials are used.

BRIEF DESCRIPTION OF THE DRAWINGS

The above and other aspects, features and advantages of the present invention will be apparent from the following more particular description thereof, presented in conjunction with the following drawings wherein:

FIG. 13 shows a device in which the holes in the perforated sheet are covered by spherical lenses collimating light onto a diffuser;

FIG. 14 shows a device with an array of cylindrical lenses with an optional diffuser above it;

DETAILED DESCRIPTION OF THE ILLUSTRATED EMBODIMENTS

A better understanding of various features and advantages of embodiments of the present luminaires may be obtained by reference to the following detailed description of the invention and accompanying drawings, which set forth illustrative embodiments in which certain principles are utilized.

Figure 1:
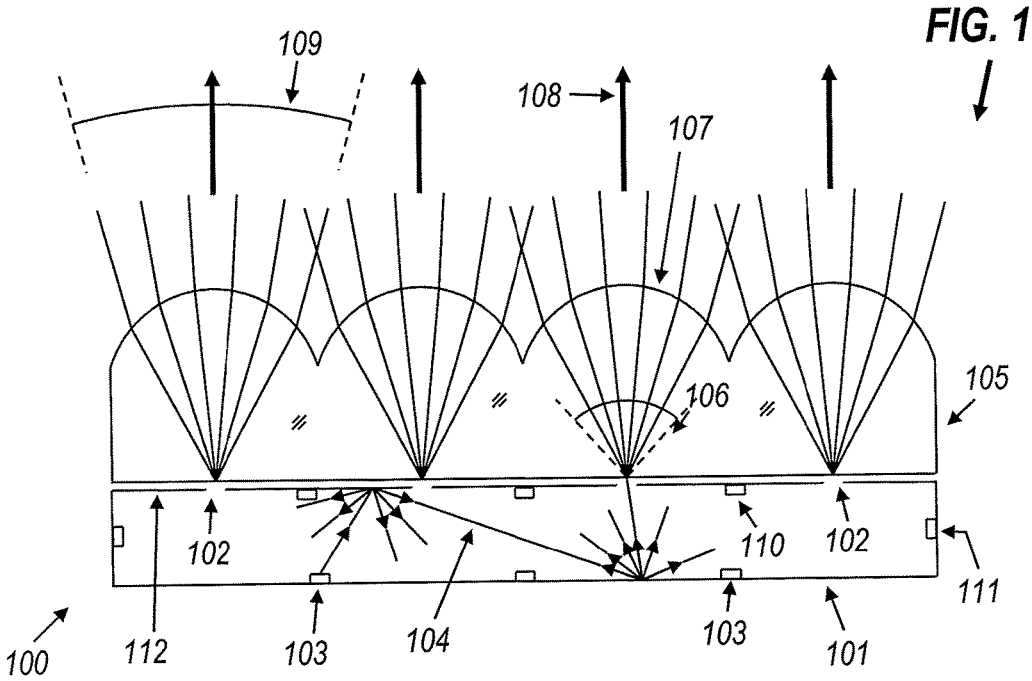
FIG. 1 shows a cross-sectional view of a mixing optic with vertical emission.

FIG. 1 shows a prior art device 100. The device 100 is a mixing optic including a mixing chamber 101 with highly reflective bottom and side walls, which may be specular and/or diffuse. This chamber is covered with reflective sheet 112, which also forms the top of the mixing chamber, which has small apertures 102. The bottom surface of reflective sheet 112 (that is to say, the surface facing away from the light output side of the device and towards the inside of the mixing chamber) is highly reflective, specular and/or diffuse. Three locations for the LEDs or other light sources are possible. They are exemplified by LEDs 103 on the bottom wall, LEDs 110 on reflective sheet 112, and LEDs 111 on the side wall. Exemplary LED emission 104 bounces around inside the mixing chamber until it exits the mixing chamber through exit apertures 102. The light then enters dielectric top optic 105 where it becomes confined to the critical angle 106 inside the dielectric material. This light is then collected by lens 107 and collimated in the vertical direction, exiting the device with angular aperture 109.

If the LEDs are on the bottom of mixing chamber 101, there may be light going out directly to the holes, which may affect uniformity and efficiency. U.S. Pat. No. 7,806,547 taught having the LEDs on either the top or the bottom, and other prior art taught having LEDs on the sides. Placing the LEDs on the underside of the top wall 112 advantageously affects uniformity, but makes it more difficult to wire the LEDs and heat sink, since these electrical and thermal components will share space with the top optic.

A uniform output is more difficult to achieve if the LEDs are placed at the bottom but wiring and heat sinking becomes easier. In this case, making the mixing chamber taller improves the uniformity but the increased diffusion of the taller lateral walls decreases efficiency. There is, therefore, a tradeoff between uniformity (taller mixing chambers) and efficiency (shallow mixing chambers). Also, the amount of light going directly from LEDs to holes without first being scattered by the mixing chamber may be reduced if the LEDs are displaced laterally relative to the holes and placed midway between the holes. This, however, is not a strict requirement.

LEDs in the mixing optic may be of different colors allowing the device to also produce light of different colors or white of varying color temperature. By dimming some LEDs or by simply turning some LEDs off, it is possible to dim the optical output.

Figure 2:
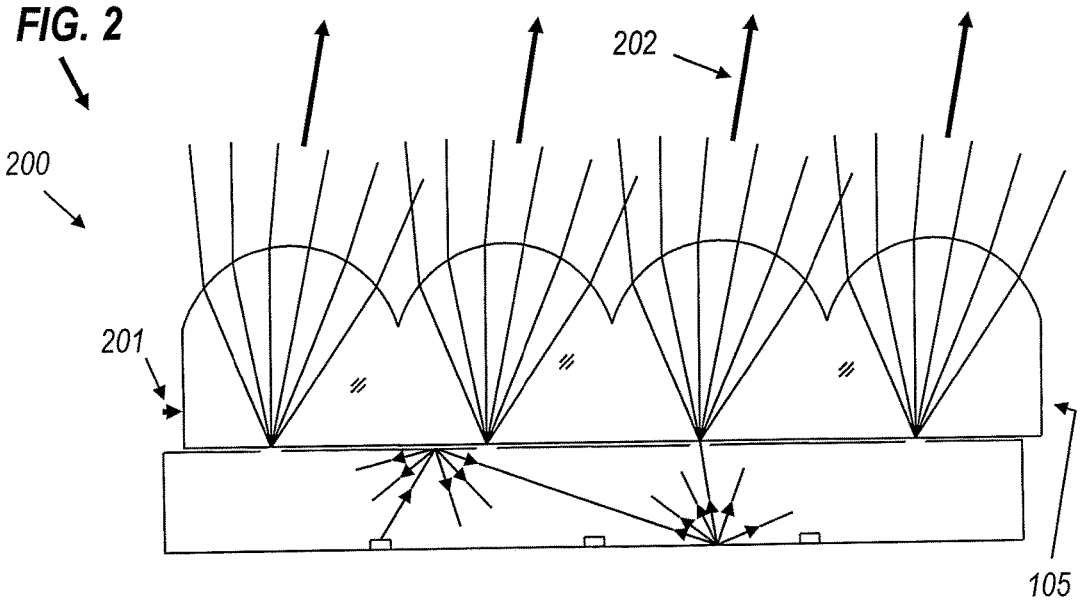
FIG. 2 shows a cross-sectional view of an embodiment of an ultra-thin luminaire with off-axis emission.

FIG. 2 shows an embodiment 200 of a luminaire as a beam steering device. It is similar to the device in FIG. 1 except that top optic 105 is movable relative to the holes 102 in the perforated sheet forming the top wall of mixing chamber 101, and may slide sideways by a displacement 201. This results in an angular displacement of the emission pattern, which now exits in direction 202. Because of refraction where the light enters the bottom surface of optic 105, the light proceeds from each hole 102 to the respective lens 107 in a conical beam, the cone angle 106 of which is determined by the critical angle at the bottom surface of optic 105, and therefore by the refractive index of the material of optic 105. The optic 105 is made thin enough that the conical beams from adjacent holes 102 do not meet within the optic 105. The gap between adjacent beams is larger than the maximum travel 201 of the optic 105, so that each conical beam is entirely captured by its respective lenslet 107 at all positions of the optic 105 in its travel 201. That avoids light rays falling on the wrong lenslet, being directed in the wrong direction, and being wasted or producing an undesired illumination.

Figure 3:
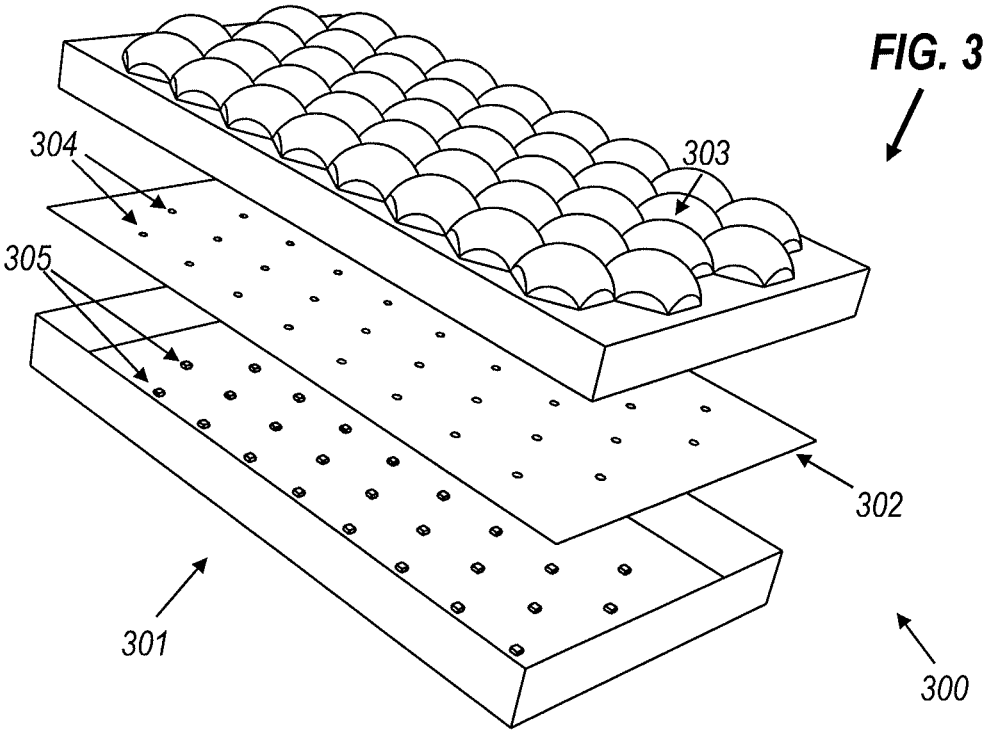
FIG. 3 shows an exploded view of the ultra-thin luminaire of FIG. 2.

FIG. 3 shows an exploded three-dimensional view of an ultra-thin luminaire 300 with mixing chamber 301 comprising covering sheet 302, and top optic array 303. The inside of the mixing chamber shows LEDs 305. Covering sheet 302 has holes 304 through which light crosses from the mixing chamber 301 into top optic 303.

In this embodiment the distributions of LEDs 305 and holes 304 can be unrelated to each other. The distributions of LEDs and holes needs not match in number or relative position. However, for improved uniformity, LEDs should be dispersed uniformly across the device. If there are LEDs of multiple colors, usually each color should preferably be dispersed uniformly in the mixing chamber. Mixing chambers are not perfect, and an uneven distribution of different colored LEDs may result in a visibly uneven color of the emitted light, which is not usually desired.

Figure 4:
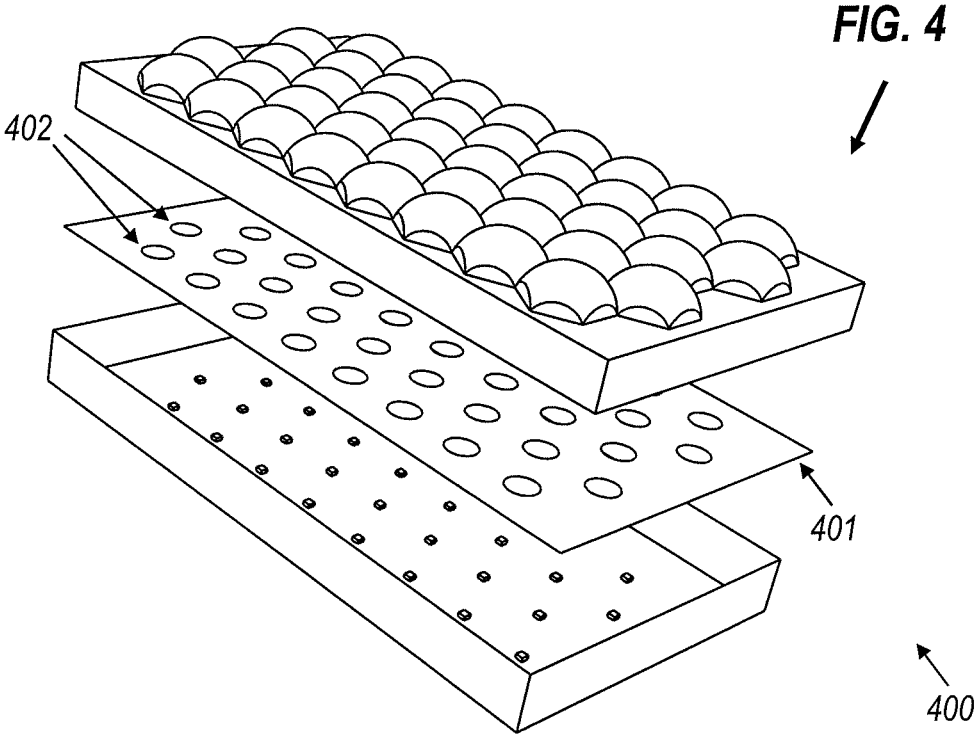
FIG. 4 shows a device similar to that of FIG. 3 but with larger holes for a wider emission pattern.

FIG. 4 shows exploded view of an ultra-thin luminaire 400 with a covering sheet 401 with larger holes 402 than the holes 304 of ultra-thin luminaire 300. This will result in a wider emission pattern than that produced by the embodiment in FIG. 3. The emission angle 109 shown in FIG. 1 will be wider in the embodiment of FIG. 4 compared to the one shown in FIG. 3. FIG. 1 approximates the holes 102 to point sources, and shows only one ray to each point of lenslet 107. In fact, most parts of lenslet 107 are illuminated by light from the whole area of the hole. As the size of holes 102, 304, 402 increases, each point of lenslet 107 will be illuminated by light from an increasing range of angles, so will emit light into an increasing range of angles.

Figure 5A:
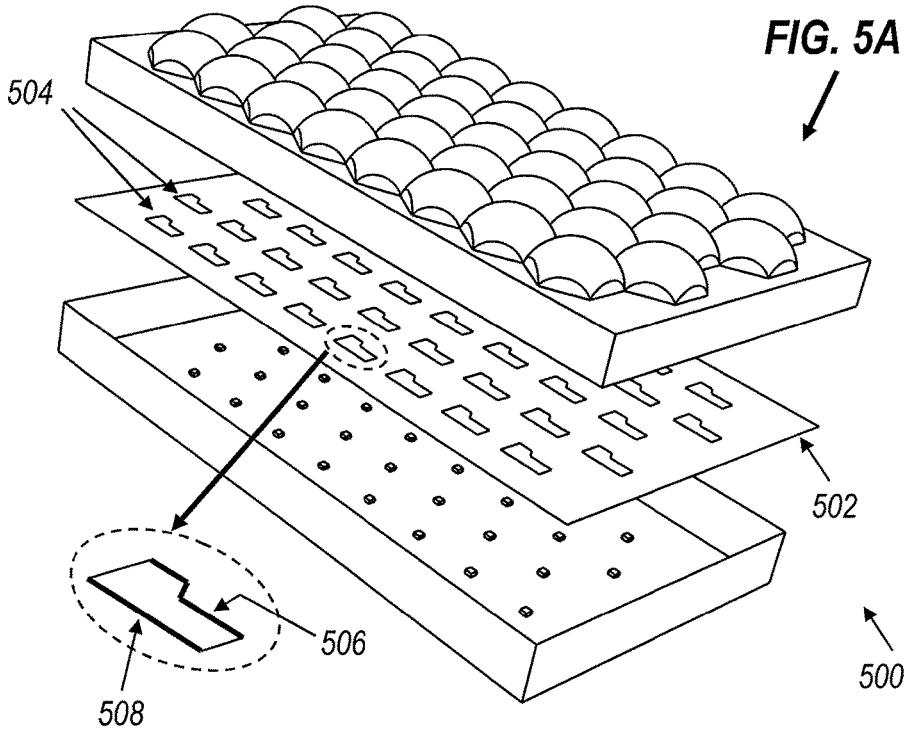
FIG. 5A shows a device similar to that of FIG. 3 but with shaped holes to produce a shaped pattern.

FIG. 5A shows embodiment 500 which is a similar device to that in FIG. 4 but now with specially shaped holes 504 in sheet 502. This shaping of the holes may be used to generate a special pattern, for example that of a low beam automotive headlamp. Edges 506 and 508 of the holes have different shapes facilitating the process of generating the desired pattern output.

Figure 5B:
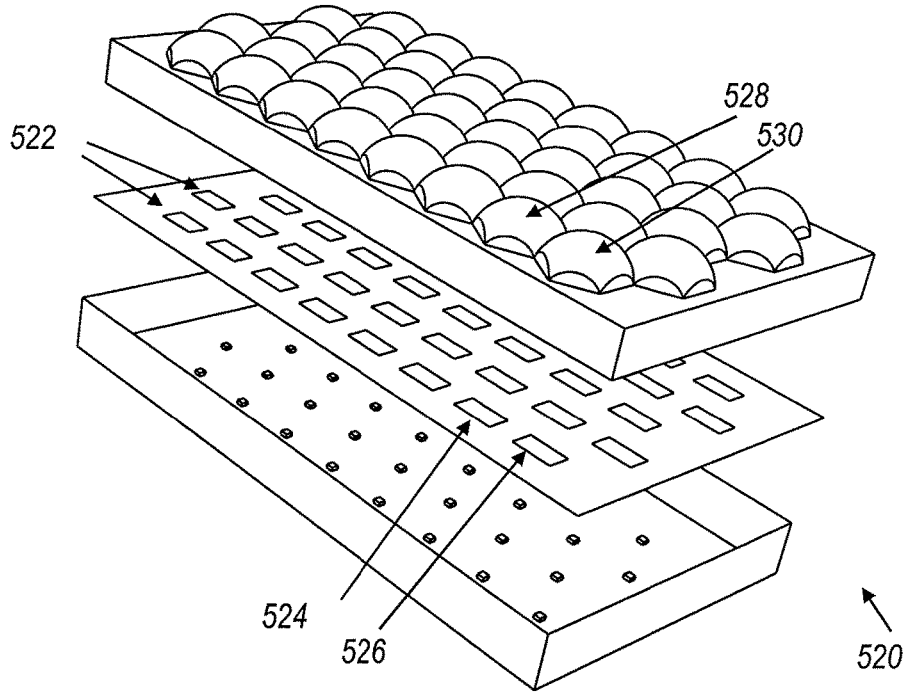
FIG. 5B shows a device similar to that in FIG. 3 but now with Liquid Crystal Displays (LCD) to control the flow of light through the holes.

Referring to FIG. 5B, in a further modification 520 of the device of FIG. 5A, the holes 524, 526 may be provided with liquid crystal device (LCD) or other switchable arrays 522, so that the effective shapes of the holes 504 can be changed electronically, even when the luminaire 500 is in use. These LCDs have the ability to either "open" the holes (letting light through) or "close" the holes (reflecting part of the light back) in response to electrical inputs. It is presently preferred to provide a separate small LCD array for each hole 524, 526, with the space in between being solid, highly reflective material, because currently available LCD devices have a reflectivity of only about 50% when in their non-transmitting state. The LCDs 522 may cover the whole or only part of the aperture of the holes 524, 526. The shape of the area covered by LCDs 522, and the shape of any area of aperture 524, 526 left uncovered by LCDs, may be of any desired shape. Different ones of the apertures 524, 526 may be different shapes, and may have different arrangements of LCD pixels. However, when switchably transmitting devices with a higher reflectivity become available, a device in which the entire sheet 502 is a switchable array of pixels may become more practical.

Light passing through holes 524 and 526 will be collected and redirected by corresponding optics 528 and 530.

If the top optics 528, 530 image the pixels of LCDs 522, and that results in an undesirably pixelated light distribution at the target, these top optics 528, 530 may be designed to redirect the light from the LCDs in slightly different directions in order to merge the images of the different LCDs into a smooth, uniform output pattern.

There are several advantages of the LCD approach as the beam output from the device can change its shape and direction in real-time without mechanical moving parts. For example, an embodiment of this invention, using the LCD array, especially when used in combination with light sources of tunable intensity, can quickly change its beam output to achieve the prescriptions for either an automotive low beam, high beam or DRL. Also since the direction of the beam can be changed by moving a "hole" away from a central position, it is possible for the beam to be steered left and right as the car goes around a corner or curve in the road. Another possibility is to have the beam direction be altered up or down or a combination of the above. This could be useful if the car's sensors pick up an oncoming car and the high beam is engaged. This might also be useful if the road undulates up and down.

The LCD approach also can be very useful for theater lighting as it can produce a wide range of shaped beams and colors, including shapes in the form of letters or objects. As there is an array of optics, multiple images can be projected at the same time.

Figure 5C:
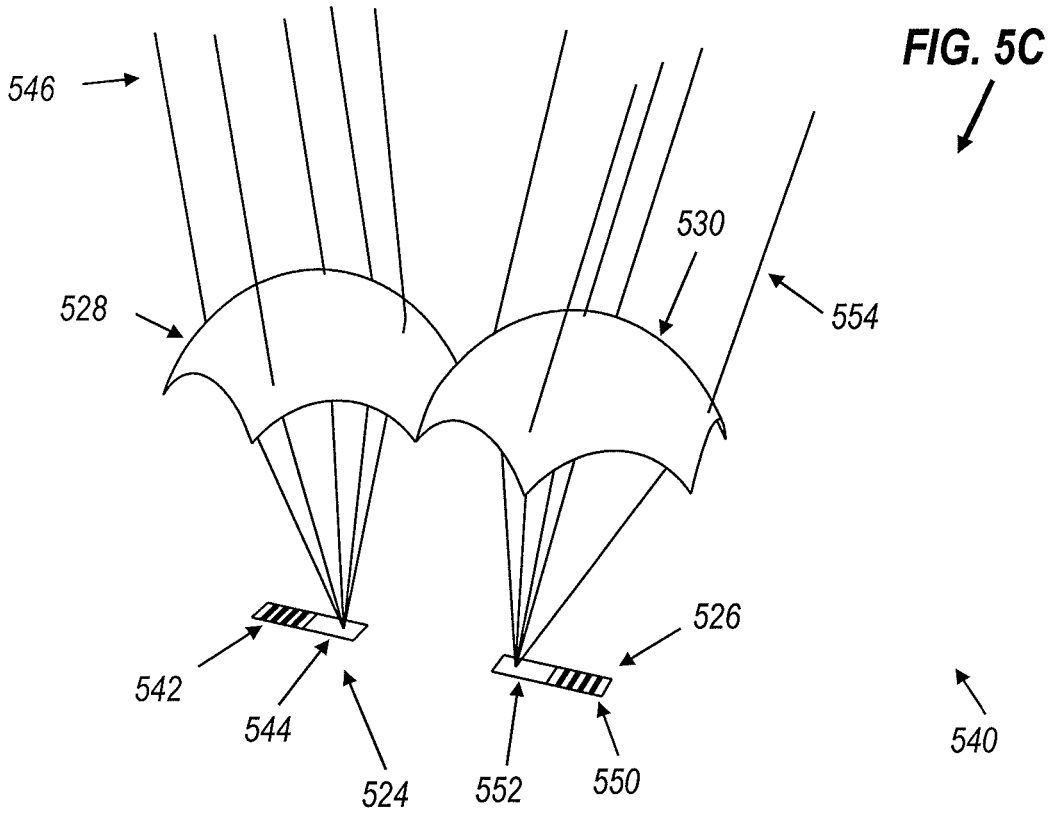
FIG. 5C shows how LCDs covering the holes may produce different emission patterns.

FIG. 5C shows an enlarged view of an arrangement 540 with the same holes 524 and 526 and corresponding optics 528 and 530 as in FIG. 5B, but now in their correct position (instead of an exploded view). LCDs 522 in holes 524, 526 may generate different shapes through which light can escape. This is illustrated by hole 524 having an area 544 that is transparent and another area 542 that is opaque. The corresponding top optic 528 redirects the light 544 passing through transparent area 544 in direction 546. Hole 526 also has an area 552 that is transparent and another area 550 that is opaque, but the transparent and opaque areas are differently positioned than in hole 524. The corresponding top optic 530 consequently redirects the light 552 passing through transparent area 552 in a direction 554 that is different from direction 546.

Because of the different transparent apertures 544, 552 produced by the holes 524 and 526, the corresponding emission patterns 546 and 554 can also be different. Transparent areas 544 and 552 may have different shapes created by the pixels of the LCD which may be electrically operated, independent of each other.

Figure 6:
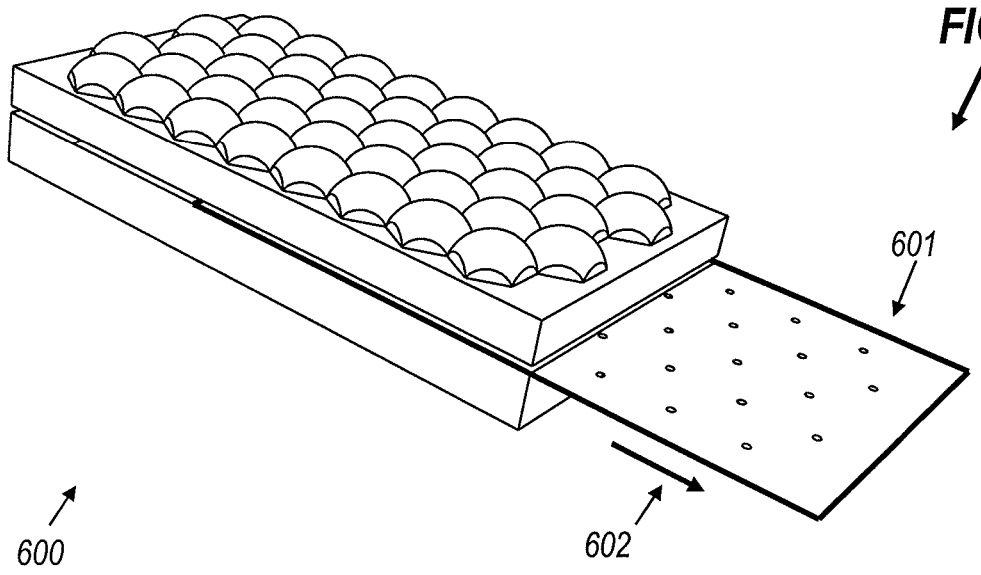
FIG. 6 shows how the perforated sheet may be slid out for replacement with a different one.

FIG. 6 shows another way in which the present luminaires may be used to generate different patterns. Ultra-thin luminaire 600 has covering sheet 601 which slides out with movement 602 for replacement with a different sheet. This allows the same device to produce various patterns, depending on the covering sheet inserted into it. Examples of different covering sheets are shown in FIG. 3, FIG. 4 and FIG. 5A.

Figure 7:
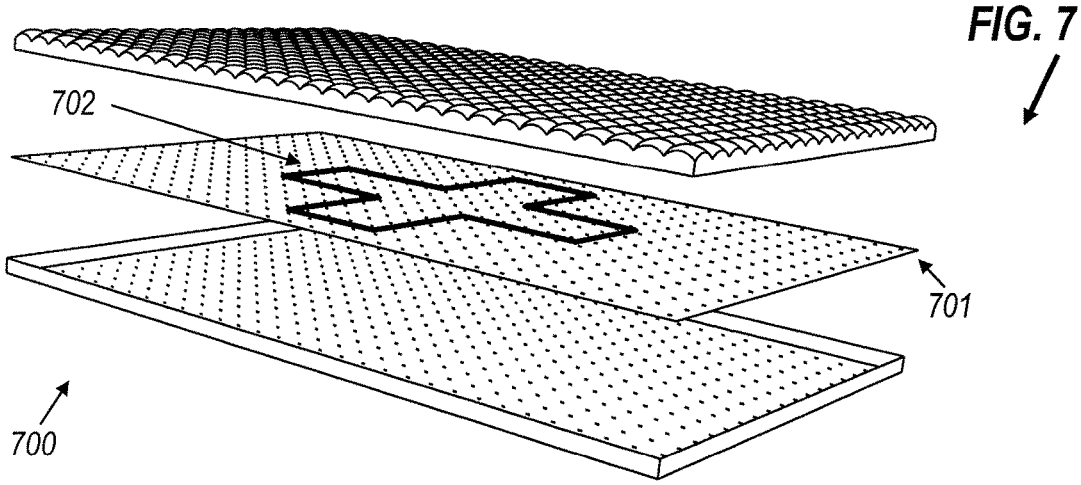
FIG. 7 is an exploded view of a device in which the perforated sheet has a drawing on top.

FIG. 7 shows an exploded view of the principal components of an ultra-thin luminaire 700 whose covering sheet 701 has a drawing or other visible design 702 on its top surface.

Figure 8:
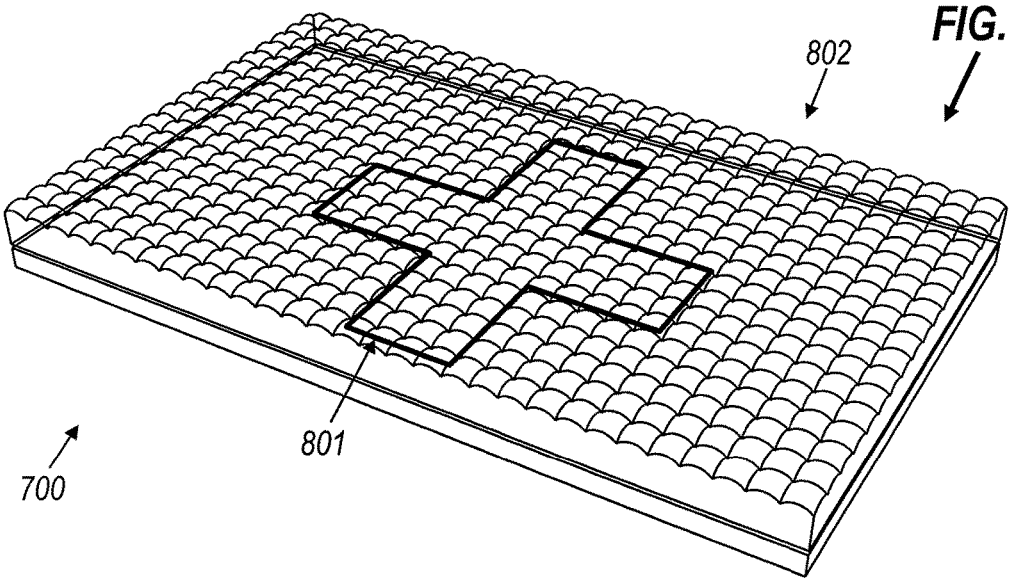
FIG. 8 shows how the drawing on the perforated sheet in FIG. 7 may be seen through the top layer when the device is unlit.

FIG. 8 shows what device 700 in FIG. 7 appears like when it is unlit. Drawing 801 on the top surface of the covering sheet can be seen through transparent top optic 802. Drawing 801 is somewhat distorted on the scale of the lenslets of top optic 802, but that may be acceptable, or may be taken into account in choosing or designing the drawing.

Figure 9:
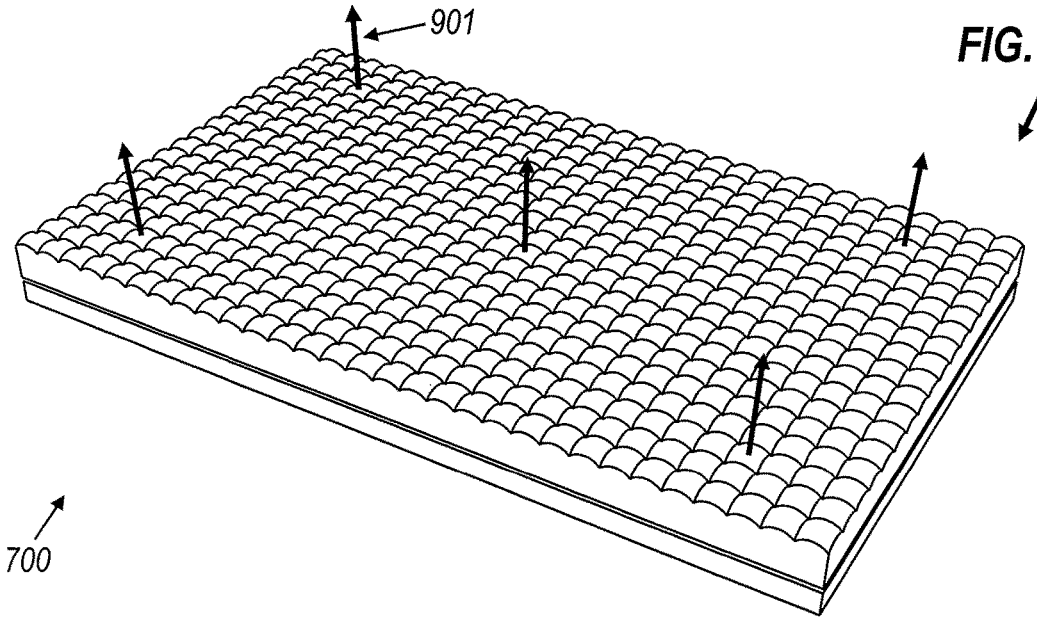
FIG. 9 illustrates how the drawing on the perforated sheet in FIG. 7 is not visible when the device is lit.

FIG. 9 shows the device 700 of FIG. 7 when it is lit. Emitted light 901 does not allow drawing 801 on the top surface of the covering sheet to be seen from within the angular region towards which light is emitted.

Figure 10:
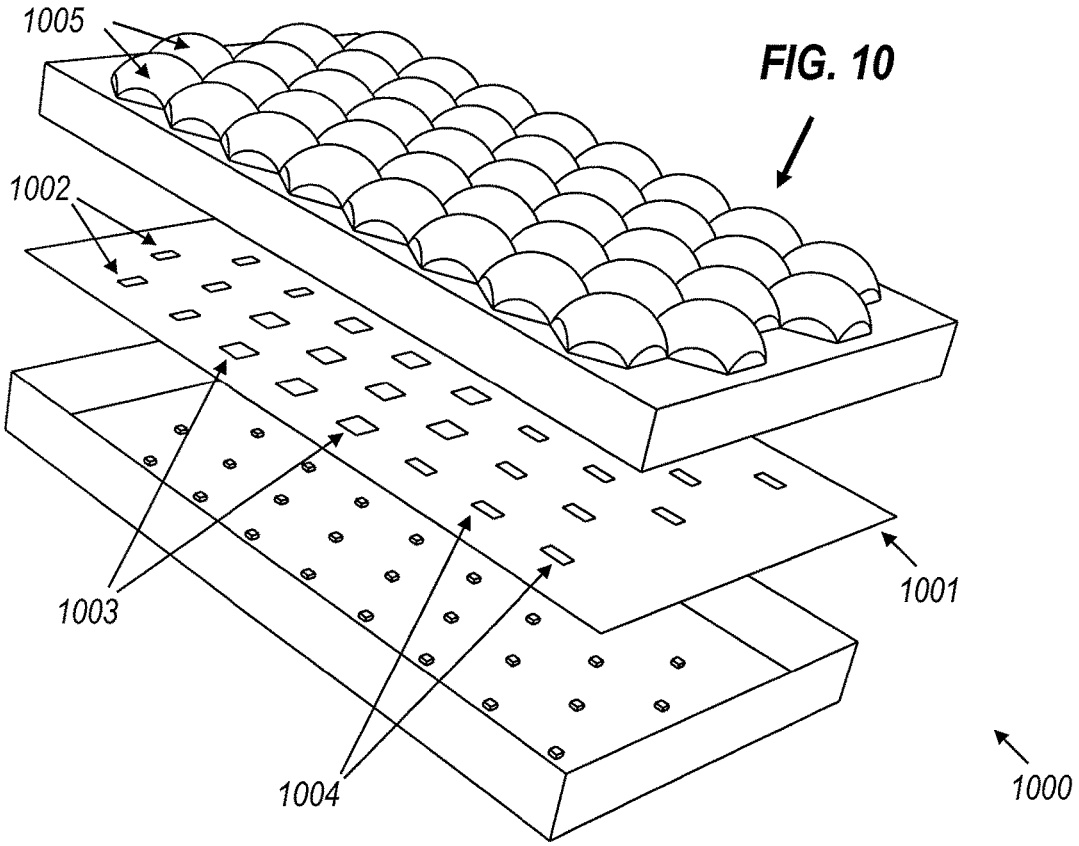
FIG. 10 shows a device in which the perforated sheet has holes of different shapes and positioned differently relative to the corresponding lenses on top.

FIG. 10 shows an ultra-thin luminaire 1000 in which holes in sheet 1001 have varying shapes and positions 1002, 1003, 1004 relative to their respective micro lenses 1005. These micro lenses 1005 may also have a varying shape. Thus, each hole and microlens pair has an individual beam shape and direction. This allows the device to produce complex output light patterns that were not previously possible.

Figure 11:
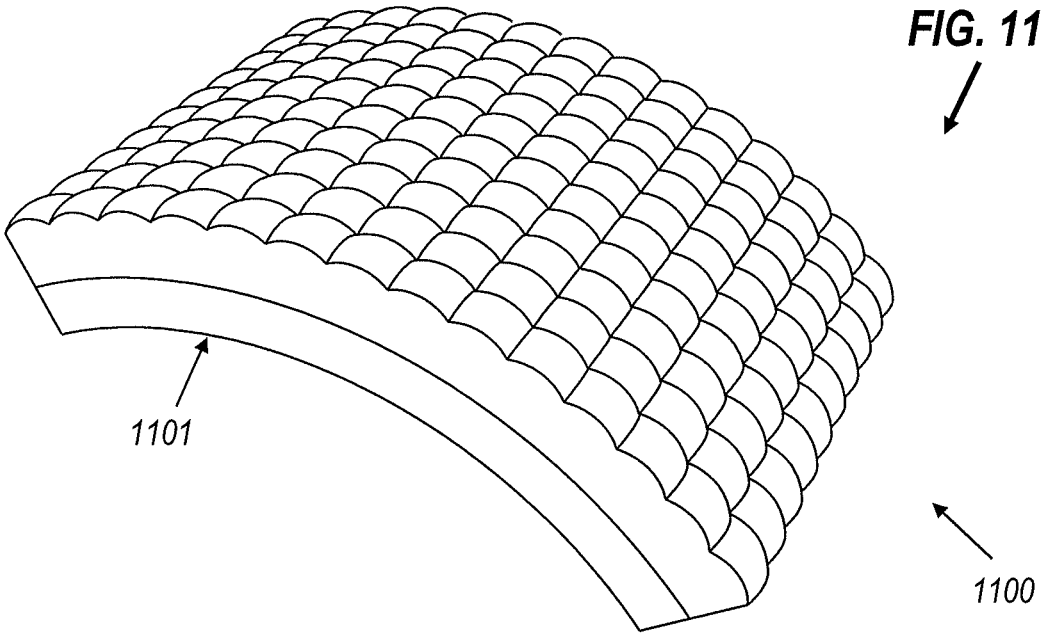
FIG. 11 shows a curved ultra-thin luminaire.

FIG. 11 shows an embodiment of an ultra-thin luminaire 1100 that has a curved mixing chamber and optic 1101. This is in contrast to prior art of flat devices, as shown in FIG. 1. The curved device 1100 can emit light round a wider range of angles. The device 1100 shown in FIG. 11 is curved in only one direction, to form an arc of a cylinder, but could of course be curved in two directions, to form part of a sphere or other double-curvature surface.

Figure 12:
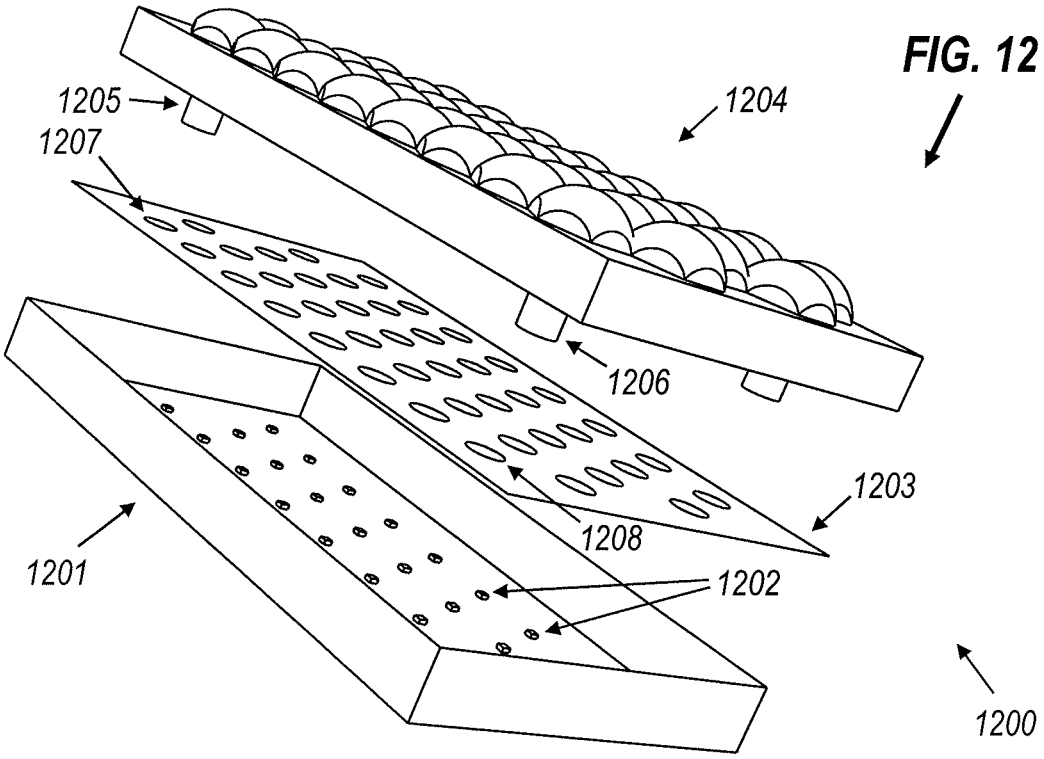
FIG. 12 shows a device in which the array of micro lenses is formed in a sheet that has pins to align it with the perforated sheet below.

FIG. 12 shows ultra-thin luminaire 1200 comprising mixing chamber 1201, LEDs 1202, perforated cover sheet 1203 forming the top wall of mixing chamber 1201, and top optic 1204 with an array of micro lenses. Also shown are exemplary pins 1205 and 1206 which mate with holes 1207 and 1208 respectively and align top optic 1204 relative to cover sheet 1203. This is an improvement over prior art (as in FIG. 1) in which the perforated slab and array of micro lenses did not have these features and, for that reason, needed external aligning components.

FIG. 13 shows a mixing optic 1300 comprising mixing chamber 1301 with highly reflective inner walls, which may be specular and/or diffuse. The top wall of mixing chamber 1301 is a cover sheet 1308 with small circular apertures 1302. The bottom surface of cover sheet 1308 (facing towards the inside of the mixing chamber) is highly reflective, and may also be specular and/or diffuse. Exemplary LEDs 1303 are placed on the walls of mixing chamber 1301 or on the bottom side of cover sheet 1308. Exemplary LED emission 1304 bounces around inside the box created by mixing chamber 1301 and cover sheet 1308 until it exits through apertures 1302. The light then enters transparent spheres 1305, each of which is seated on a respective aperture 1302 in sheet 1308, and exits as collimated beams 1306. This light then optionally hits transmissive diffuser 1307 and exits the device as wide beam emission 1309. Diffuser 1307 may or may not be holographic. If diffuser 1307 is holographic, then the light exiting can be collimated with a circular or asymmetric beam pattern.

The spheres may be held in place, for example, by transparent glass plate 1310 that presses spheres 1305 against apertures (holes) 1302.

FIG. 14 shows a luminaire 1400 with an arrangement of linear cylindrical lenses 1403 along linear shaped slits 1401 in a cover sheet 1402. Lenses 1403 are supported at the ends by structure 1404. Light crossing cylindrical lenses 1403 will be scattered by diffuser 1406, which can be holographic, as it exits the optic.

The area bounded by corners 1407, 1408, 1409 and 1410 is covered by a highly reflective wall (not shown for figure clarity). The other three walls are also highly reflective on the inside. In an alternative embodiment, the diffuser 1406 and the side reflectors above the cover sheet are eliminated. In this approach the cylindrical lenses 1403 will collimate the light in one direction but in the other direction the beam will have a wide beam angle. If cylindrical lenses 1403 are slightly above slits 1401, the support structure 1404 may also allow the cylindrical lenses 1403 to move laterally with respect to the slits 1401 in the cover sheet, as indicated by arrow 1405. Then, the collimated beam direction can be steered off-axis.

The support structure 1404 can be molded at the same time as cylindrical lenses 1403, so that they are one unitary part. This may result in cost savings in some configurations and applications.

Figure 15:
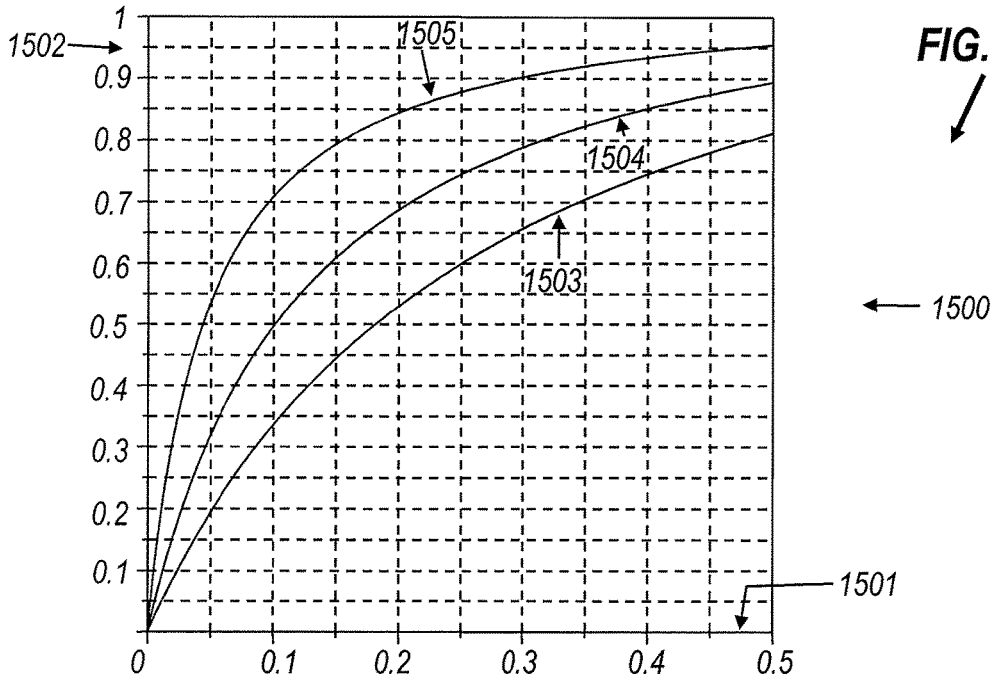
FIG. 15 shows a graph with efficiency curves based on several parameters for the ultra-thin luminaire.

Graph 1500 of FIG. 15 shows how the efficiency of the mixing chamber changes with its internal reflectivity and $f_H$, the fraction of top surface occupied by holes. Horizontal axis 1501 represents $f_H$ and vertical axis 1502 the extraction efficiency. Curves 1503, 1504 and 1505 are for internal chamber reflectivity of 90%, 95% and 98% respectively. Curves 1503, 1504 and 1505 presented in this graph are in good accordance with real extraction efficiencies when the mixing chamber is shallow (horizontal dimension much larger than vertical) or when the side walls are specularly reflective with high reflectivity.

These curves are taught in prior art U.S. Pat. No. 7,806,547 which provides a mathematical formula for estimating the efficiency of a mixing chamber that can also be applied to embodiments disclosed in this invention:

$$F_{out}=T(1-\rho_B\rho_T)$$

where $$T=(1-\rho_H)f_H$$

is the transmission of the top surface and $$\rho_T=T_H\rho_H+\rho_W(1-f_H)$$

is the average top surface reflectivity and $\rho_W$=reflectivity of top surface (can be either diffuse of specular)

$\rho_H$=reflectivity of the holes $\rho_B$=reflectivity of bottom surface (typically a diffuse reflector but can also be specular)

$f_H$=fraction of top surface occupied by holes

If $d_H$ is the hole diameter (assumed constant) and $S_H$ is the hole spacing then, for instance, for rectangular arrays, $f_H=\pi d_H^2/4S_H^2$.

As an example of application of the curves in this graph, consider the case in which one wishes to produce a beam output with a full width half maximum of 45 deg (half-angle 22.5 deg). Each one of refractive optics on top of the holes has a ratio between entrance aperture (covering the hole) and exit aperture area (through which light exits the device) given by $f_H$. If this optic was ideal, then $1/f_H=1/\sin(22.5\text{ deg})^2$, or $f_H=0.15$. Choosing now the vertical line at $f_H=0.15$ in axis 1501, one gets a cavity extraction efficiency of about 50% for curve 1503, 60% for curve 1504 and 80% for curve 1505 for internal chamber reflectivity of 90%, 95% and 98% respectively.

Figure 16:
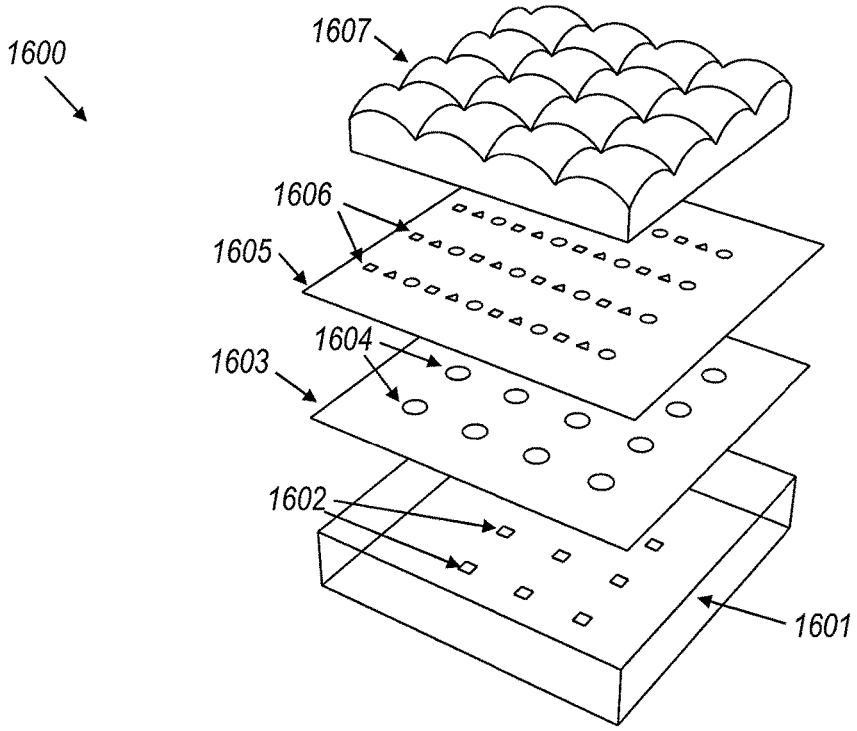
FIG. 16 shows an exploded view of a device with two perforated sheets superimposed.
Figure 17:
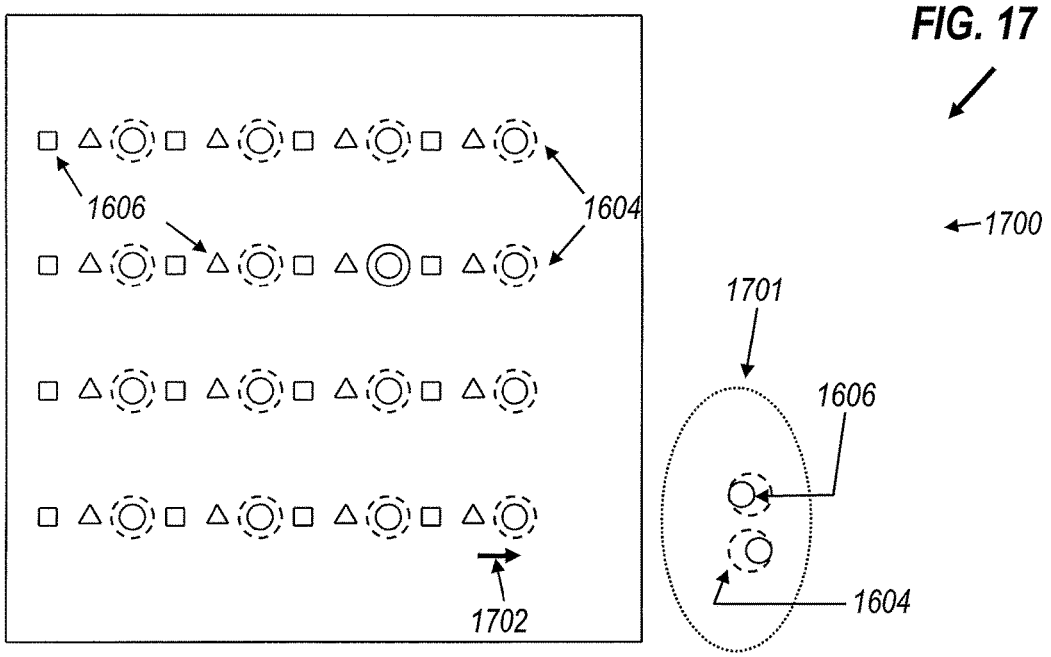
FIG. 17 shows how the relative movement of two perforated sheets allows beam change and beam steering.

Referring to FIGS. 16 and 17, by combining the features of FIGS. 5A and 6, a movable covering sheet 1605 may be produced with two offset arrays of different shapes of holes 1606. By moving the sheet 1605, like sheet 601, through the amount of the offset, the device may switch between the two hole shapes, and the corresponding beam shapes. In order to improve selectivity, the movable covering sheet 1605 may be overlaid with a fixed sheet 1603 having large holes 1604, similar to those shown in FIG. 4. Then, the active array of holes 1606 align with the fixed holes 1604, while the inactive array of holes 1606 do not align with the fixed holes 1604 and are closed off.

FIG. 16 shows an exploded view 1600 of an ultra-thin luminaire 1600 comprising mixing chamber 1601, LEDs 1602, perforated cover sheet 1603 with large holes 1604, perforated cover sheet 1605 with small holes 1606 of varying shapes, and top optic 1607 with an array of micro lenses. The two cover sheets 1603, 1605 together form the top wall of mixing chamber 1601. Either cover sheet 1603 or 1605 may be on top. As shown in the drawings, cover sheet 1603 faces the mixing chamber.

The bottom surface of sheet 1603 is highly reflective, as is the bottom surface of sheet 1605, at least where sheet 1605 may be exposed to the mixing chamber through the holes in sheet 1603. These sheets are assembled on top of each other (in close proximity) and on top of chamber 1601. Microlens array 1607 is placed on top of the upper perforated cover sheet (which in this embodiment is sheet 1605) in close proximity. Sheet 1605 is mounted so as to be movable laterally relative to sheet 1603 below it. Sheet 1605 may also have a figure drawn on it that will be visible when the device is off FIG. 17 shows a top view 1700 of sheet 1605 on top of sheet 1603. Holes 1604 of sheet 1603 are shown as dashed lines to illustrate the fact that they are underneath sheet 1605. Sheet 1605 may be moved laterally relative to sheet 1603 underneath it. If the movement is small (as illustrated by detail 1701), then the shape of the light beam pattern remains the same, but is steered in different emission directions as the holes 1606 move relative to lenses 1607. However, if the lateral movement is large, as indicated by arrow 1702, the first set of holes 1606 (circles) of sheet 1605 will move outside circles 1604 of sheet 1603 and the second set of holes 1606 (triangles) of sheet 1605 will come into alignment with holes 1604. Since the array of micro lenses 1607 projects this shape onto the far field, the beam pattern will change from round to triangular. When the triangles are on top of holes 1604, small lateral movements (horizontal, vertical, diagonal or in any other direction) will result in beam steering. A larger movement of sheet 1605 in the direction of arrow 1702 will place the third set of holes 1606 (squares) on top of circles 1604 changing the emission pattern to square.

The circles, triangles and squares are just illustrations (for figure clarity) of the capabilities of the present luminaire. An actual device 1600 may have holes 1606 of various shapes chosen to produce desired beam patterns, as illustrated in FIG. 5A, and even varying shape across sheets 1603 and 1605, as illustrated in FIG. 10.

Although the concept is illustrated with horizontal movements of sheet 1605 relative to sheet 1603 in a single direction 1702 (horizontal in FIG. 17), there may be also vertical or diagonal (as seen in FIG. 17) relative movements. Extra holes in sheet 1605 may be spaced from the illustrated holes 1606 in those directions, allowing for a wider variety of patterns to be produced.

Specially shaped holes as in FIG. 5A of varying shapes as in FIG. 10 may be used to produce special output patterns, such as automotive low beam. Also, by having two superimposed sheets with different perforations, the emission pattern may be changed. In particular, it is possible to increase the light emission, changing a low beam into a high beam coming from the same device.

Figure 18:
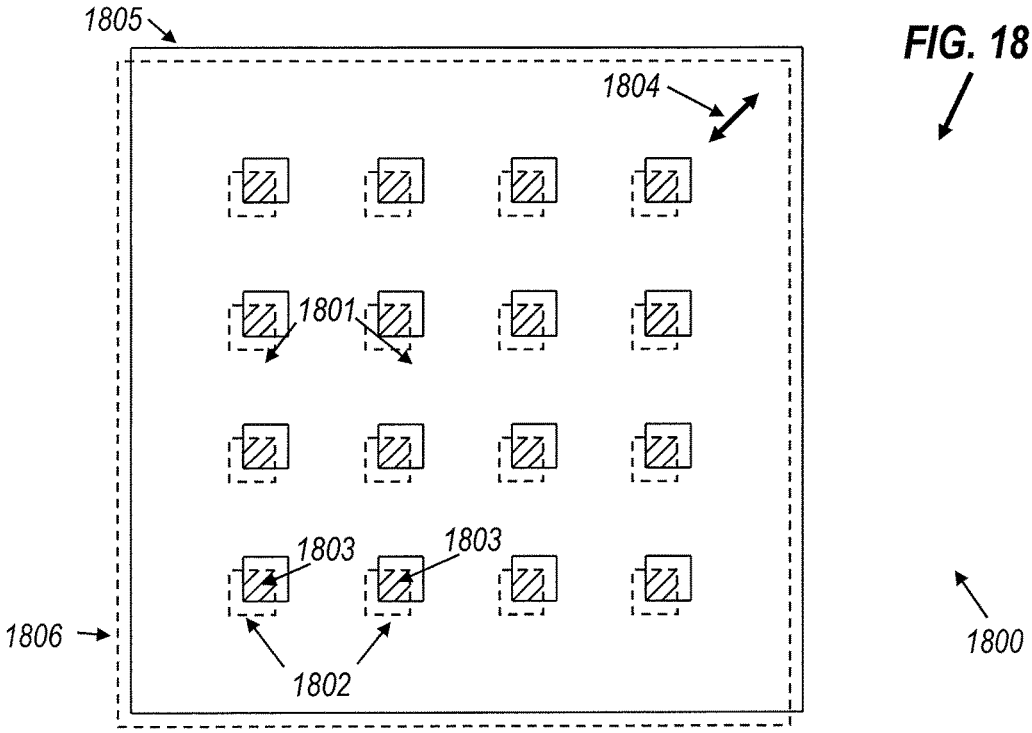
FIG. 18 shows how the relative movement of two perforated sheets allows the device to behave as a zoom optic.

FIG. 18 shows another embodiment 1800 of the present invention with sheet 1805 with holes 1801 atop sheet 1806 with holes 1802. The areas 1803 through which light can escape the mixing chamber below are the intersection of holes 1801 and 1802. By moving sheets 1805 and 1806 relative to each other in the direction of arrow 1804 the size of the holes may be varied. The micro lenses on top will then project these holes to the far field, producing a beam of varying angular aperture. This embodiment of the present invention then acts as a zoom optic. By moving the two sheets 1805, 1806 together, so as to control the position of the center of open area 1803 relative to optic 1607, the direction of the output beam can be steered.

Figure 19:
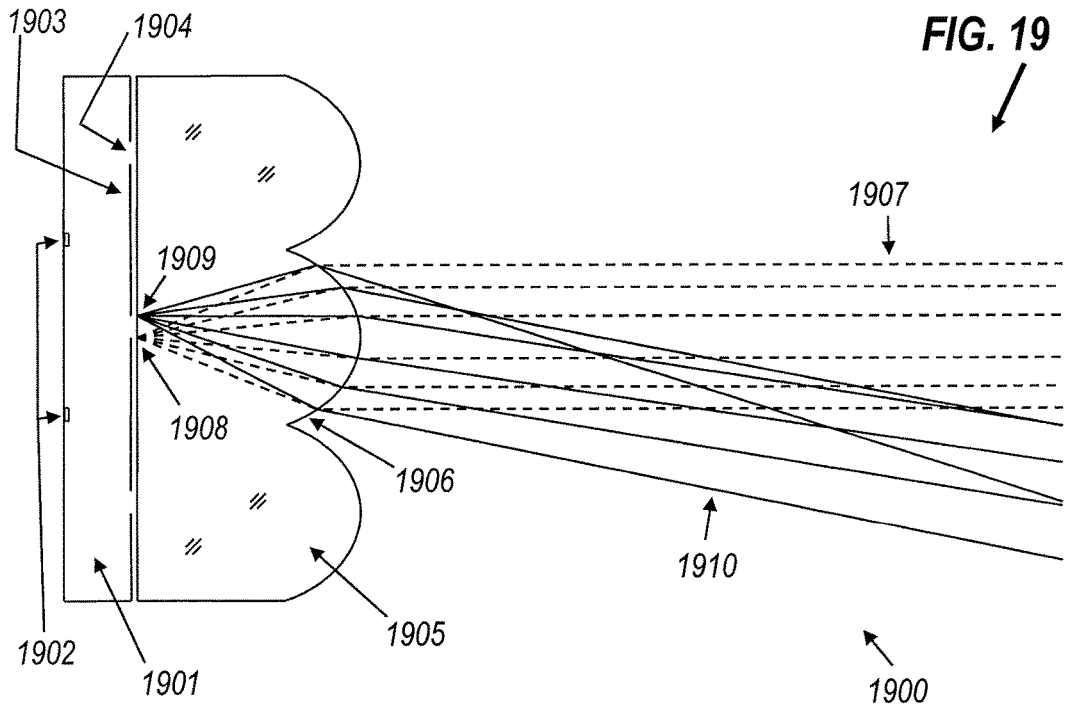
FIG. 19 shows how the present invention may be designed to produce a sharp cut off pattern necessary for an automotive low beam.

FIG. 19 shows another embodiment 1900 composed of mixing chamber 1901 with LEDs 1902 and covered with reflective sheet 1903, forming the top surface of mixing chamber 1901, which has small apertures 1904. Light escaping the holes enters top optic array 1905 to be redirected in a preferred direction.

As shown in FIG. 19, optic 1906 is mounted vertically, and is designed in such a way that rays 1907 (dashed lines) coming from bottom edge 1908 of the hole 1904 are emitted in the horizontal direction (as a set of parallel rays). This arrangement ensures that no light is emitted above the horizontal direction. This light would have to come from positions below 1908, but no light is coming from those points because it is blocked by reflective sheet 1903. The result is a sharp cut off from light to dark at the horizontal direction (light below the horizontal and dark above the horizontal). This is an important characteristic of an optic that aims at producing an automotive low beam pattern to avoid blinding incoming traffic. The bottom edge 1908 of the aperture 1904 may be shaped according to the shape needed for the sharp cutoff, by specially shaped holes 504 as shown in FIG. 5A. Bottom edge 1908 could, for example, be shaped as edge 506 in FIG. 5A or as edge 508 in FIG. 5A, to facilitate generating a desired output pattern. Other shapes are also possible. The optics may have to be large enough so that a good image of the whole edge is produced. If the shape of the hole is produced by an LCD with many pixels, different optics may aim in slightly different directions in so that the whole device produces a pattern with no artifacts.

Optic 1906 will not in general produce a sharp image of the top edge 1909 of the hole, as shown by rays (solid lines) 1910 which are emitted in varying directions. As a result, the beam that is optimized to have a sharp cut-off above rays 1907 will have a more gradual cut-off below rays 1910. This, however, is a desirable feature in an automotive low beam design, producing a smooth transition between illuminated and dark portions of the road ahead of the car.

The preceding description of the presently contemplated best mode of practicing the invention is not to be taken in a limiting sense, but is made merely for the purpose of describing the general principles of the invention. Various changes may be made. For example, although distinct embodiments have been described, the skilled reader will understand how features of different embodiments may be combined in one device.

The full scope of the invention should be determined with reference to the Claims.

We claim:

1. A luminaire comprising:

a mixing chamber having an array of apertures in one wall;

a light source to supply light into the mixing chamber, the light source mounted on a wall of the mixing chamber at a location that does not cause light emitted from the light source to directly exit the apertures but causes reflection and scattering of the emitted light within the mixing chamber before passing through an aperture of the array; and an array of lenses outside the mixing chamber, each positioned to cooperate with a respective one of the apertures to emit light from the mixing chamber as a beam; and wherein the array of lenses and at least an effective edge of the array of apertures are relatively displaceable parallel to said one wall;

wherein the array of lenses are configured to steer a direction of the beam based on the relative displacement.

2. The luminaire of claim 1, further comprising at least a second array of apertures in said one wall, and wherein the relative displacement is operative to cause the array of lenses to cooperate with the first said array of apertures or with said second array of apertures.

3. The luminaire of claim 1, comprising a first cover sheet having said array of apertures, further comprising a second cover sheet having an array of second apertures different from the apertures of the first said array of apertures, and wherein said cover sheets are exchangeable so that said array of lenses cooperate with a selected one of said arrays of apertures.

4. The luminaire of claim 1, comprising a first cover sheet having said array of apertures, further comprising a second cover sheet having a second array of apertures, and wherein said cover sheets are relatively displaceable so that an overlap between apertures of the first said array of apertures and apertures of said second array of apertures forms effective apertures of variable sizes.

5. The luminaire of claim 1, wherein the array of apertures are defined at least in part by controllably transmissive elements, said at least one effective edge being displaceable by changing said controllably transmissive elements between a more transparent and a more reflective state.

6. The luminaire of claim 1, wherein said apertures are of selected asymmetrical shapes and cooperate with said lenses to produce a beam of light of a corresponding selected asymmetrical shape.

7. The luminaire of claim 6, wherein said corresponding selected asymmetrical shape of said beam of light is a beam suitable for a low-beam headlight for a motor vehicle.

8. The luminaire of claim 1, further comprising a transmissive diffuser that is hit by light from the array of optics.

9. The luminaire of claim 1, wherein the light source is an array of LEDs located within the mixing chamber, the mixing chamber having reflective walls, and wherein a plurality of the LEDs are mounted on the wall of the mixing chamber that is opposite from the wall that includes the apertures.

10. A luminaire comprising:

a mixing chamber having an array of fixed apertures in one wall;

a light source to supply light into the mixing chamber, the light source mounted on a wall of the mixing chamber at a location that does not cause light emitted from the light source to directly exit the apertures but causes reflection and scattering of the emitted light within the mixing chamber before passing through an aperture of the array; and an array of optics outside the mixing chamber, each positioned to cooperate with a respective one of the fixed apertures to emit light from the mixing chamber as a beam; and wherein at least one of said array of fixed apertures and said array of optics are non-uniform such that different pairs of an optic and its respective fixed aperture cooperate to produce beams of light that are different in at least one of shape and direction, said different beams combining to form an overall beam of a desired beam pattern.

11. A luminaire comprising:

a mixing chamber having an array of apertures in one wall;

a light source to supply light into the mixing chamber, the light source mounted on a wall of the mixing chamber at a location that does not cause light emitted from the light source to directly exit the apertures but causes reflection and scattering of the emitted light within the mixing chamber before passing through an aperture of the array; and an array of optics outside the mixing chamber, each positioned to cooperate with a respective one of the apertures to emit light from the mixing chamber as a beam; and wherein an external surface of said one wall bears a pattern or design that is visible through said array of optics at least when said luminaire is not illuminated.

12. The luminaire of claim 11, wherein the light source is an array of LEDs located within the mixing chamber, the mixing chamber having reflective walls, and wherein a plurality of the LEDs are mounted on the wall of the mixing chamber that is opposite from the wall that includes the apertures.

13. A false ceiling comprising a luminaire according to claim 11 and comprising ceiling panels that are not luminaires adjacent to said luminaire, wherein said pattern or design on said one wall of said luminaire combines with a visible appearance of said adjacent ceiling panels to form a unified pattern or design.

14. The luminaire of claim 10, wherein the light source is an array of LEDs located within the mixing chamber, the mixing chamber having reflective walls, and wherein a plurality of the LEDs are mounted on the wall of the mixing chamber that is opposite from the wall that includes the apertures.

* * * * *